US005203036A

United States Patent [19]

Juushi

[11] Patent Number: 5,203,036

[45] Date of Patent: Apr. 20, 1993

[54] APPARATUS FOR DELIVERING LAYING PAPER FOR CLOSET SEAT

[75] Inventor: Hiroyuki Juushi, Saitama, Japan

[73] Assignee: Nihon-Isued Co., Ltd., Saitama, Japan

[21] Appl. No.: 722,557

[22] Filed: Jun. 25, 1991

[30] Foreign Application Priority Data

Sep. 28, 1990 [JP] Japan ..... 2-259840

[51] Int. Cl.[5] ..... A47K 13/20

[52] U.S. Cl. ..... 4/243.3; 4/243.1; 4/244.2

[58] Field of Search ..... 4/243.1, 243.2, 243.3, 4/244.1, 244.2; 83/649

[56] References Cited

U.S. PATENT DOCUMENTS

| | | | |
|---|---|---|---|
| 1,467,481 | 9/1923 | Juline | 83/649 |
| 2,767,409 | 10/1956 | Bacci | 4/243.1 |
| 4,106,135 | 8/1978 | Mannheim | 4/244.1 |
| 4,738,176 | 4/1988 | Cassia | 83/649 |

FOREIGN PATENT DOCUMENTS

| | | | |
|---|---|---|---|
| 0540181 | 6/1956 | Italy | 4/244.2 |

*Primary Examiner*—William A. Cuchlinski, Jr.
*Assistant Examiner*—W. Morris Worth
*Attorney, Agent, or Firm*—Wenderoth, Lind & Ponack

[57] ABSTRACT

An apparatus for delivering paper for a water closet seat has; a lid whose rear end is rotatably supported by a box secured to the upper rear of a closet bowl: the closet seat being under the lid with the rear end thereof being rotatably and vertically movably supported by the box and urged upwardly by a spring. A ratchet driving portion including a ratchet is rotatably supported by the box and a pawl is attached to the lid. By the opening of the lid, the pawl engages the ratchet to rotate the ratchet through a predetermined angle. A paper delivery roller portion including a driving roller is rotatable by the rotation of the ratchet driving portion and a pressure roller pressure-contacted to the driving roller is rotatable by the rotation of the driving roller. The paper is clamped between the driving roller and the pressure roller, and the paper is pulled out by the rotation of the aforesaid two rollers and the paper having a predetermined length is delivered between the lid and the closet seat. A cutter portion is disposed on the paper delivery roller portion which includes a stationary lower blade disposed below the paper and a movable upper blade vertically movably disposed over the paper. The movable upper blade is associated in operation with the vertical movement of the rear end portion of the closet seat and descends when pushed down by the closet seat to cut off the paper.

1 Claim, 15 Drawing Sheets 63
63
66
65
4
4
62
L
K
3
3
4
2
12
14
9
16

APPARATUS FOR DELIVERING LAYING PAPER FOR CLOSET SEAT

BACKGROUND OF THE INVENTION

1. Field of the Invention

This invention relates to an apparatus for delivering paper for covering a water closet seat and more particularly to an apparatus for delivering paper for a closet seat, wherein roll-shaped paper can be reliably and stably delivered onto a closet seat in a predetermined length by the opening of a lid member and the paper delivered onto the closet seat can easily be cut off only by a user sitting on the closet seat.

2. Description of the Prior Art

There has been utilized paper laid on a water closet seat in order to avoid unsanitary feeling by directly contacting the closet seat with the skin and to alleviate the cold feeling at the time of sitting on the closet seat. The sheets of paper for the closet seat used in the past is stored in a storage case and superposed one over one in a position close to the closet, and taken out for use one by one from the storage case when necessary.

However, to supply the conventional paper for the closet seat, the paper is superposed one over one and stored in the storage case and taken out one by one for use when necessary, whereby the way of using it is troublesome. Moreover, the paper for the closet seat is shifted in position by the user's clothes and the like at the time of laying the paper onto the closet seat and sitting thereon, so that there are many cases where the conventional paper is useless as the paper for the closet seat, thereby making it necessary to pay full attention to the use.

SUMMARY OF THE INVENTION

An object of the present invention is to provide an apparatus for delivering paper for a closet seat, wherein the paper for the closet seat is delivered by a pair of rollers including a driving roller and a pressure roller pressure-contacting each other so as to be reliably and stably delivered onto the closet seat in a predetermined length, and the paper laid on the closet seat can be easily cut off when a user sits on the seat.

To achieve the above-described object, according to the present invention, the apparatus for delivering the paper for the closet seat comprises: a lid member, the rear end portion of which is rotatably supported by a box member secured to the upper rear side of the closet; the closet seat of the closet, said closet seat being superposed on the lid member from below, the rear end portion thereof being rotatably and vertically movably supported by the box member and further urged upwardly by springs, a ratchet driving portion including a ratchet rotatably supported by the box member and a pawl provided on the lid member, wherein the pawl engages the ratchet by the opening of the lid member to rotate the ratchet through a predetermined angle; a paper delivery roller portion including a driving roller rotatable by the rotation transmitted from the ratchet driving portion and a pressure roller disposed in parallel to the driving roller, pressure-contacted with the outer peripheral surface of the driving roller and rotatable by the rotation of the driving roller, wherein paper from a roll stored in the box member is clamped between the driving roller and the pressure roller, and the paper is pulled out from the roll by the rotation of the driving roller and the pressure roller and the paper having a predetermined length is delivered between the lid member and the closet seat: and a cutter portion disposed on the delivering side of the paper delivering roller portion, including a stationary lower blade disposed below the paper and a movable upper blade vertically movably disposed over the paper, in which the movable upper blade is associated in operation with the vertical movement of the rear end portion of the closet seat and descends when pushed downwardly by the downward movement of the closet seat to thereby cut off the paper between the movable upper blade and the stationary lower blade.

When the lid member is opened, the pawl provided on the lid member engages the ratchet and the ratchet rotates through the predetermined angle. When this ratchet rotates, the driving roller receives the rotation thus transmitted to rotate, and simultaneously, the pressure roller pressure-contacted thereto also rotates. The paper from the roll stored in the box member and clamped between the driving roller and the pressure roller is pulled out by the rotation of the driving roller and the pressure roller, delivered between the lid member and the closet seat in the predetermined length, and the paper delivered is laid on the closet seat. When the user sits on the closet seat in this state, the rear end portion of the closet seat which has been urged upwardly by springs moves downward, the movable upper blade descends with this downward movement of the rear end portion of the closet seat and the delivered paper is cut off by the movable upper blade and the stationary lower blade.

BRIEF DESCRIPTION OF THE DRAWINGS

The drawings show embodiments of the present invention, in which.

DETAILED DESCRIPTION OF THE PREFERRED EMBODIMENTS

The present invention will be described below in detail with reference to the embodiments shown in the accompanying drawings.

Figure 1:
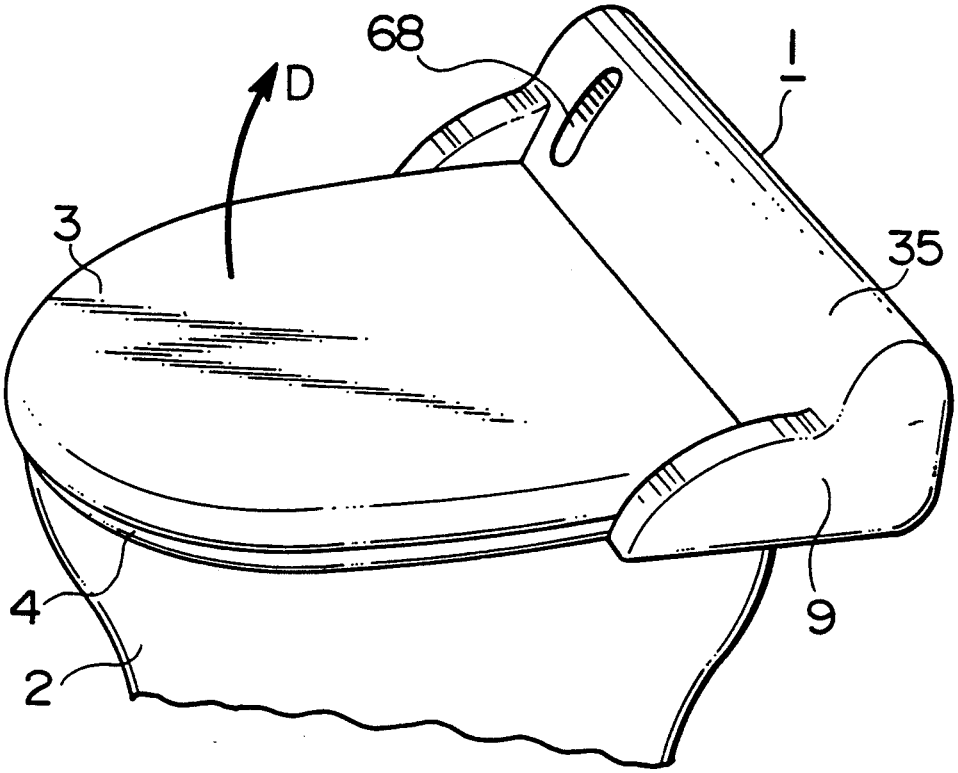
FIG. 1 is an explanatory view showing a state where the apparatus for delivering the paper for the closet seat according to the present invention is installed on the closet.
Figure 2:
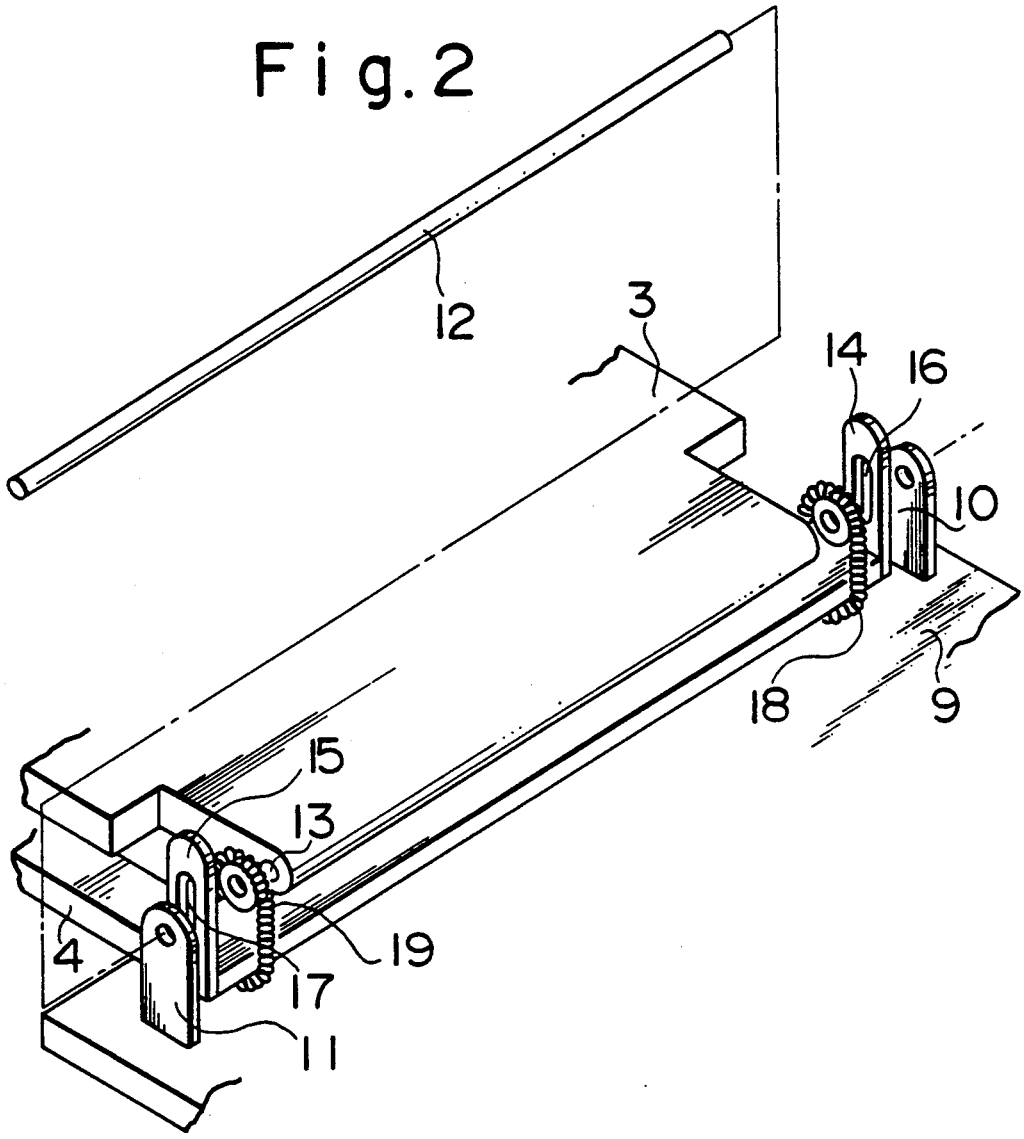
FIG. 2 is a partial explanatory view showing the lid member supported by the box member, and the rear end portion of the closet seat therearound.

Referring to the drawings, an apparatus 1 for delivering a protective paper for a water closet seat according to the present invention is secured to the upper rear side of a closet bowl 2 as shown in FIG. 1.

This apparatus 1 for delivering paper for a closet seat is constituted by a lid member 3 of a closet bowl 2, a closet seat 4 of the closet bowl 2, a ratchet driving portion 5 driven by the opening of the lid member 3, a paper delivery roller portion 7 for receiving the rotation transmitted from the ratchet driving portion 5 to rotate, pull out paper 6 from a roll and deliver the paper between the lid member 3 and the closet seat 4 in a predetermined length, and a cutter portion 8 for cutting off the paper 6 delivered from the paper delivery roller portion 7.

First, the lid member 3 and the closet seat 4 will be described.

A shaft 12 is supported by two support pieces 10, 11 extending upwardly from the top surface at the forward end portion of a bottom plate of a box member 9. Designated at 13 is a hole formed in the rear end portion of the lid member 3, and the shaft 12 is inserted through the hole 13 in such a manner that the lid member 3 is freely rotatable. Designated at 14, 15 are mounting pieces provided on opposite sides of the rear end portion of the closet seat 4. These mounting pieces 14, 15 are provided therein with slots 16, 17 in the vertical direction. The shaft 12 which has been inserted through the hole 13 of the lid member 3 is inserted through the slots 16, 17 in a state where the closet seat 4 is engaged against the lid member 3 from below. Thus, the lid member 3 is rotatably supported at the rear end portions thereof by the shaft 12, and the closet seat 4 engaged against the lid member 3 from below is supported at the rear end portion thereof by the same shaft 12 rotatably and vertically movably along the slots 16, 17. Designated at 18, 19 are springs urging the rear end portions of the closet seat 4 upwardly. The rear end portion of the closet seat 4 is movable upwardly from the resilience of the springs 18, 19, the shaft 12 is positioned in the lower portions of the slots 16, 17, and, when pressure is applied to the closet seat 4 from above, the rear end portion of the closet seat 4, being guided by the slots 16, 17, moves downwardly against the resiliency of the springs 18, 19.

Next, the ratchet driving portion 5 will be described.

Designated at 20 is a ratchet rotatably mounted on the shaft 12, 21 are teeth, and 22 is a pawl for engaging one of the teeth 21 of the ratchet 20 to rotate the ratchet 20. The pawl 22 is secured to the lid member 3 via a mounting shaft 23, and, when the lid member 3 opens or rotates upwardly, the pawl 22 engages one of the teeth 21 of the ratchet 20 to rotate the ratchet 20.

Figure 3:
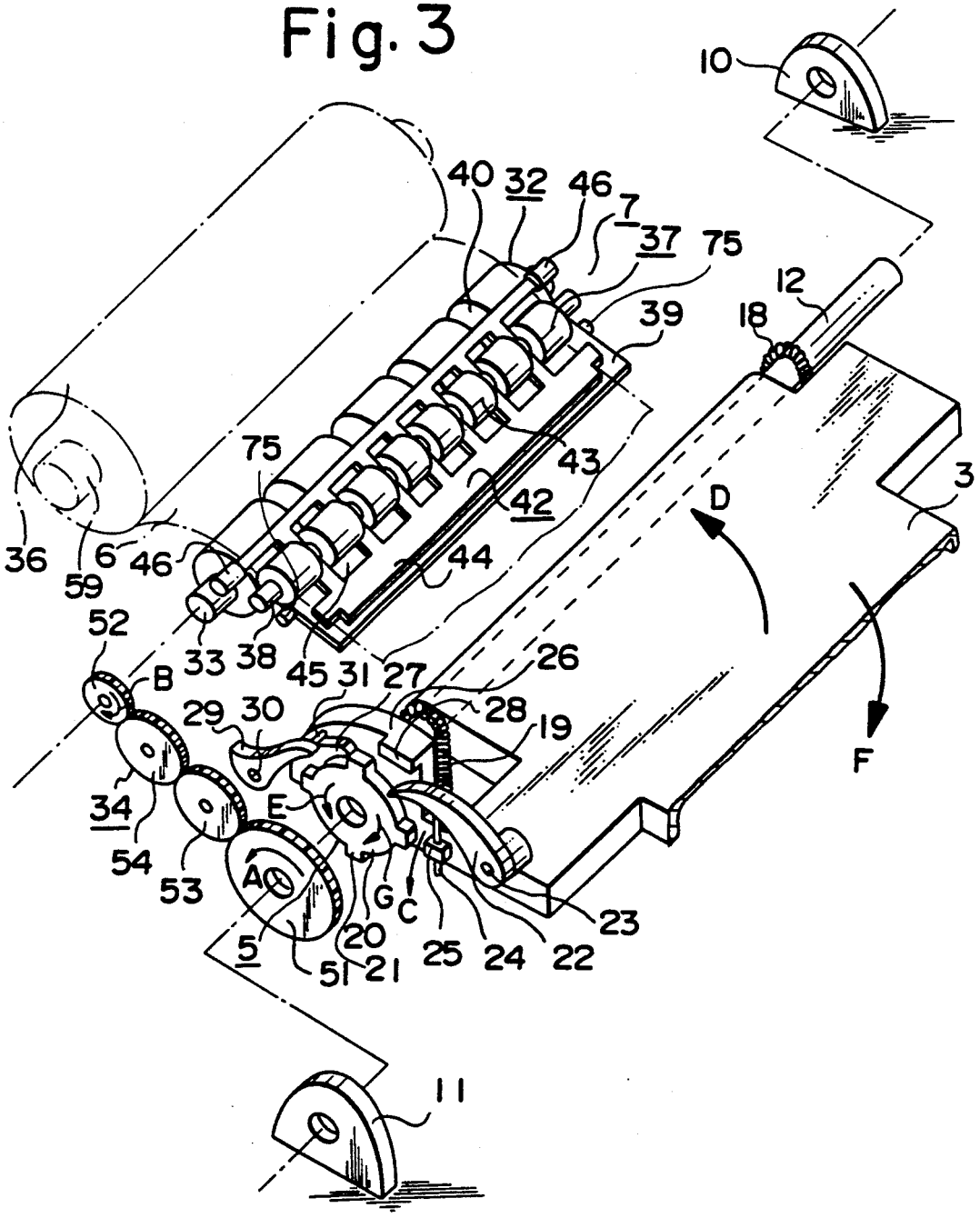
FIG. 3 is an exploded explanatory view showing the ratchet driving portion and the paper delivery roller portion.
Figure 4:
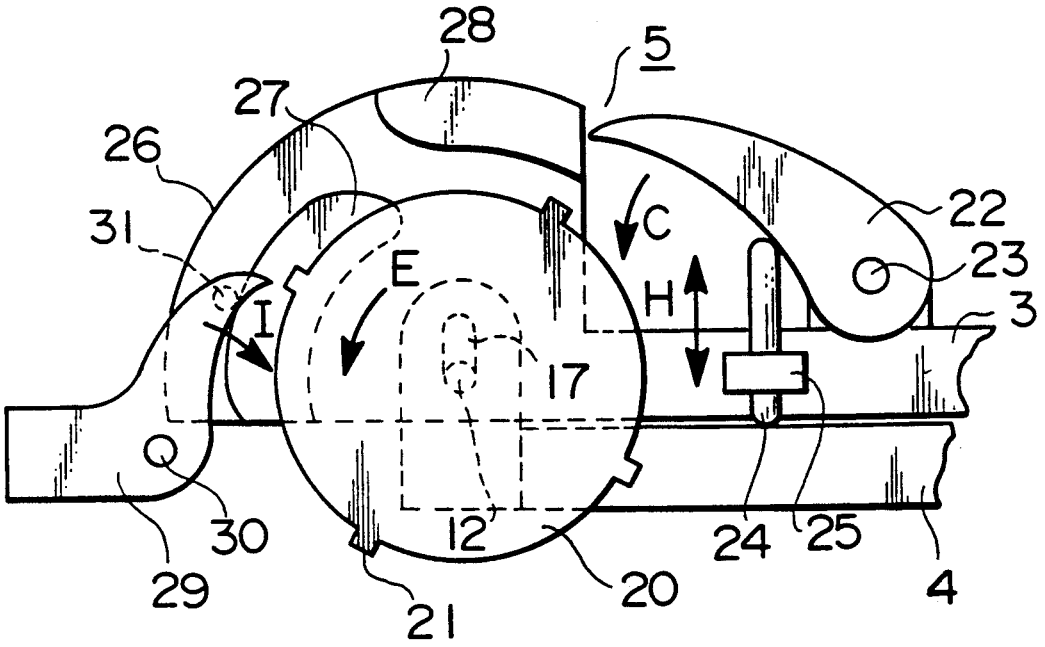
FIG. 4 is an enlarged side view of the ratchet portion shown in FIG. 3.

The pawl 22 secured to the lid member 3 is constantly biased by the spring (not shown) in a direction of the ratchet 20 (direction indicated by an arrow C in FIGS. 3 and 4). Denoted at 24 is a pawl releasing lever for releasing the pawl 22 from the ratchet 20, vertically slidably provided (in a direction indicated by an arrow H in FIG. 4) on the side surface of the lid member 3 through a mounting member 25, and abutted at the bottom end portion thereof against the top surface of the closet seat 4. In a state where the lid member 3 is closed, i.e. the lid member 3 is superposed on the closet seat 4, the pawl releasing lever 24 is pushed upwardly by the top surface of the closet seat 4, and the top end portion thereof pushes up the pawl 22 in a direction opposite to the direction of urging of the pawl 22, so that the pawl 22 is released and disengaged from the ratchet 20 (FIG. 4). Accordingly, when only the lid member 3 is opened (in a direction indicated by an arrow D in FIG. 3), the pawl releasing lever 24 moves in a direction indicated by an arrow 3 in FIG. 5, the pawl 22 is released from the pressure by the top end portion of the pawl releasing lever 24, is urged in the direction of the ratchet 20 (a direction indicated by an arrow C in FIG. 4), and engages the ratchet 20 to rotate it in a direction indicated by an arrow E in FIG. 4. When the lid member 3 and the closet seat 4 are opened together, although the lid member is opened, the pawl 22 is in a state of being released from the ratchet 20, so that the ratchet 20 does not rotate.

Figure 5:
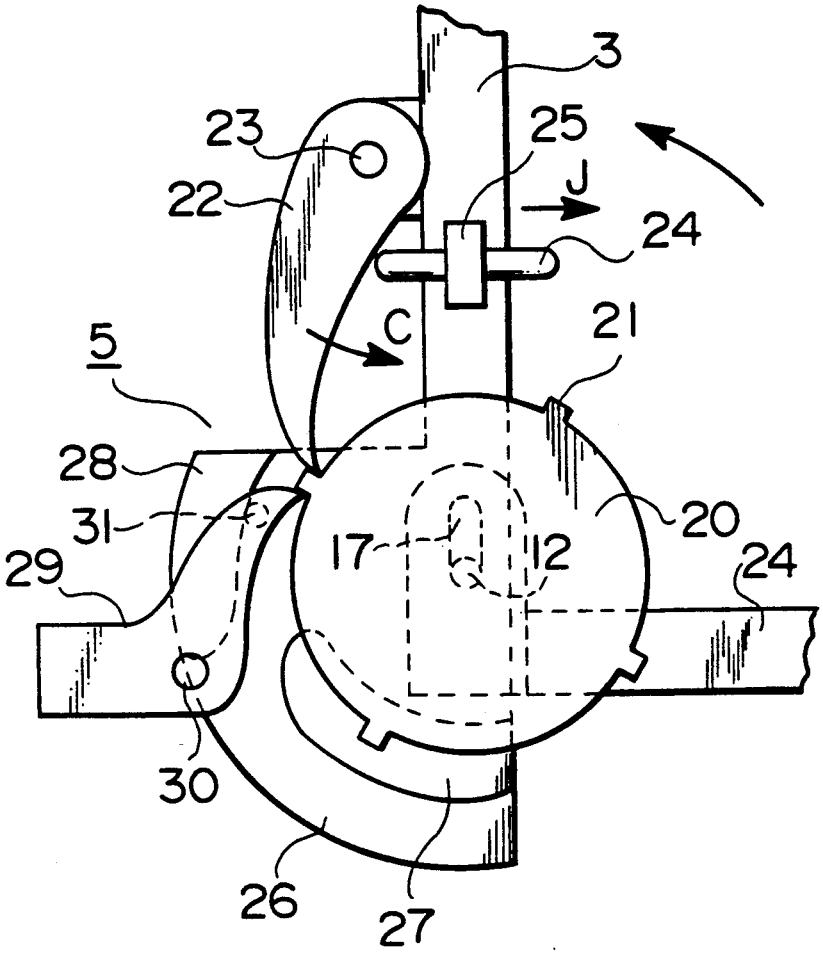
FIG. 5 is an explanatory view of the portion shown in FIG. 4 showing a state where the ratchet is rotated.
Figure 6:
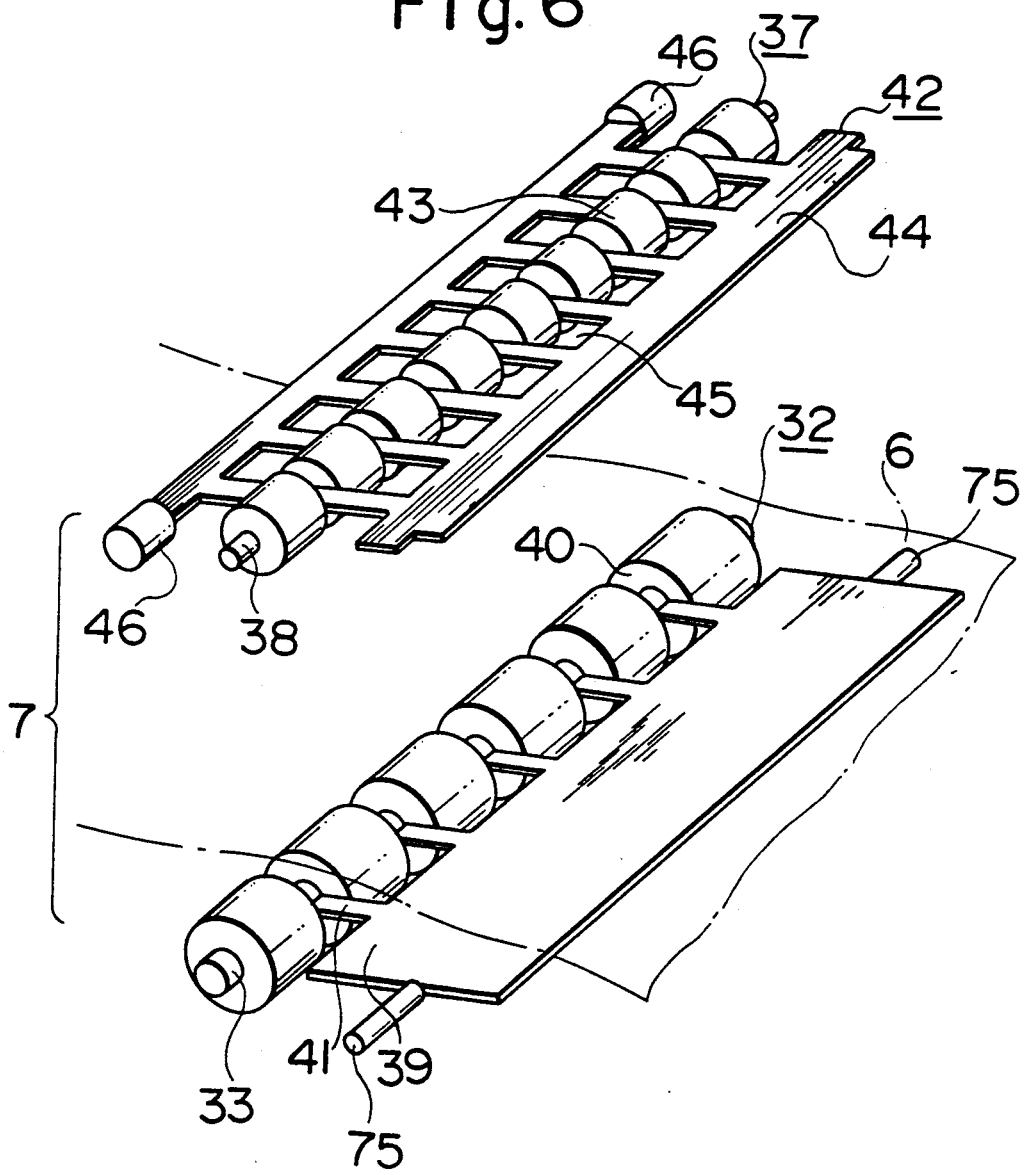
FIG. 6 is an exploded explanatory view showing the paper delivery roller portion.

Designated at 26 is a segmental stopper guide provided on the rear end portion of the lid member 3 on the side of the ratchet 20. Raised guide portions 27, 28 are provided on the outer surface of the stopper guide 26. Denoted at 29 is a stopper rotatably mounted on the box member 9 and constantly urged by a spring, not shown, in a direction indicated by an arrow I in FIG. 4. Denoted at 31 is a pin provided at the forward end portion of the stopper 29, which slides on the top surface of the raised guide portion 27 and the bottom surface of the raised guide portion 28 when the lid member 3 is opened. Namely, when the stopper guide 26 is rotated by the opening of the lid member 3, the pin 31 of the stopper 29 initially slides on the top surface of the raised guide portion 27, then, leaving the top surface of the raised guide portion 27, abuts against the bottom surface of the raised guide portion 28, and subsequently is pushed down by being guided by the bottom surface of the raised guide portion 28, whereby the forward end of the stopper 29 engages one of the teeth 21 of the ratchet 20, and, when the lid member 3 is fully opened, the rotation of the ratchet 20 is stopped (FIG. 5).

Incidentally, in this embodiment, four teeth of the ratchet 20 are provided at equal intervals. With the ratchet 20 having such a number of teeth 21, the opening angle of the lid member 3 is set at 90 degrees only when the lid member 3 is fully opened, so that incomplete opening of the lid member 3, no matter how many times it may be repeated, does not rotate the ratchet 20.

Description will hereunder be given of the paper delivery roller portion 7 rotated by the rotation transmitted from the ratchet driving portion 5, pulling out the paper 6 and delivering it between the lid member 3 and the closet seat 4 in the predetermined length.

Denoted at 32 is a driving roller and at 33 a roller shaft rotatably supported by the box member 9 and rotated by the rotation transmitted from the ratchet driving portion 5 through a rotation transmitting portion 34 which will hereunder be described in detail.

The driving roller 32 is disposed in parallel to a roll 36 of the paper 6 stored in a storage portion 35 in the box member 9. As for the material of this driving roller 32, one being elastic and having a high coefficient of friction is preferred, and rubber and polyurethane are most suitable.

Designated at 37 is a pressure roller and 38 a roller shaft. The pressure roller 37 is disposed in parallel to the driving roller 32, pressure-contacts the outer peripheral surface of the driving roller 32 and is supported to be rotatable by the rotation of the driving roller 32.

This driving roller 32 and pressure roller 37 clamp the roll 36 of the paper 6 stored in the storage portion 35 of the box member 9 therebetween, pull out the paper 6 by the rotation of the driving roller 32 and the pressure roller 37 and deliver the paper 6 between the lid member 3 and the closet seat 4.

Denoted at 39 is an introducing plate supported by the box member 9 for introducing the paper delivered from the driving roller 32 and the pressure roller 37 into a space formed between a stationary lower blade 62 and a movable upper blade 63 in the cutter portion 8 to be described hereunder.

Designated at 75 are engageable shafts provided at opposite sides of the introducing plate 39. These engageable shafts 75 are engaged with support members 55, 56 to be described hereunder.

Formed on the driving roller 32 are circumferential grooves 40 spaced in the axial direction at predetermined intervals. The introducing plate 39 is provided on one side thereof with small pieces 41 arranged like comb teeth, corresponding to the circumferential grooves 40, each having a width smaller than the width of the circumferential groove 40. The small pieces 41 are inserted into the circumferential grooves 40, respectively, so that the paper 6 delivered from the driving roller 32 and the pressure roller 37 slides on the introducing plate 39 and is delivered forwardly, i.e. to the cutter portion 8, without being rolled downwardly.

Denoted at 42 is a keeper plate supported by the box member 9, for holding from above the paper 6 delivered from the driving roller 32 and the pressure roller 37 and introduced on the introducing plate 39 to prevent the paper 6 from warping upwardly.

The pressure roller 37 has a plurality of rollers 43 made of rubber or synthetic resin provided on the roller shaft 38 in the axial direction at predetermined intervals. The keeper plate 42 has a plate member 44 thereof with holes 45, into which the rollers 43 can be loosely coupled, corresponding to the rollers 43. This plate member 44 is formed at opposite ends of the top side thereof with shafts 46 engageable with the box member 9. The above-described keeper plate 42 is disposed between the driving roller 32 and the pressure roller 37 and above the introducing plate 39 provided on the driving roller 32, with the rollers 43 of the pressure roller 37 being positioned in the holes 45 of the keeper plate 42 and pressure-contacted with the driving roller 32.

Thus, the paper 6 delivered from the driving roller 32 and the pressure roller 37 enters between the introducing plate 39 and the keeper plate 42 and is guided to the cutter portion 8.

Figure 7:
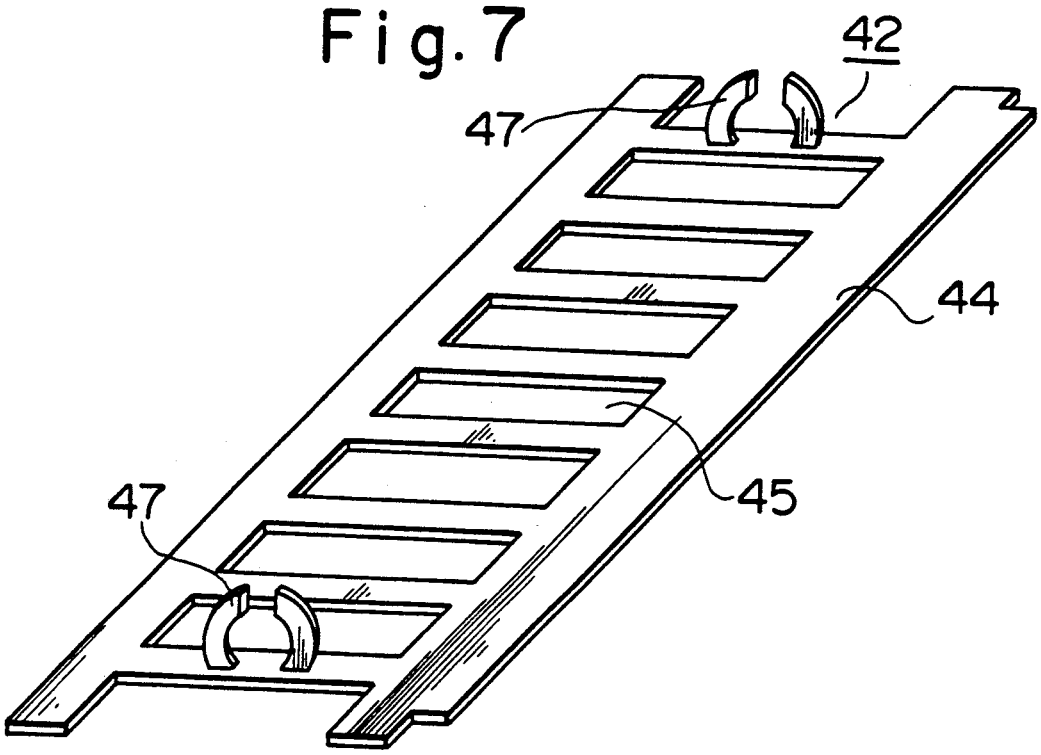
FIG. 7 is a perspective view showing another example of a keep plate.
Figure 8:
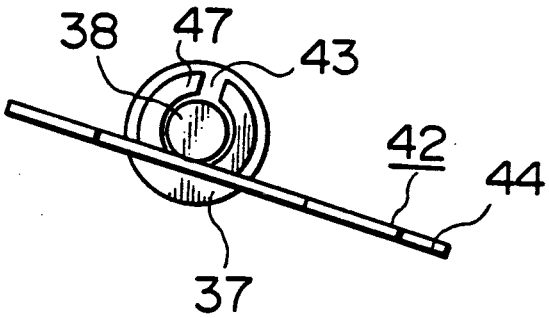
FIG. 8 is a side view showing a state where the keep plate shown in FIG. 7 is secured to the pressure roller.
Figure 9:
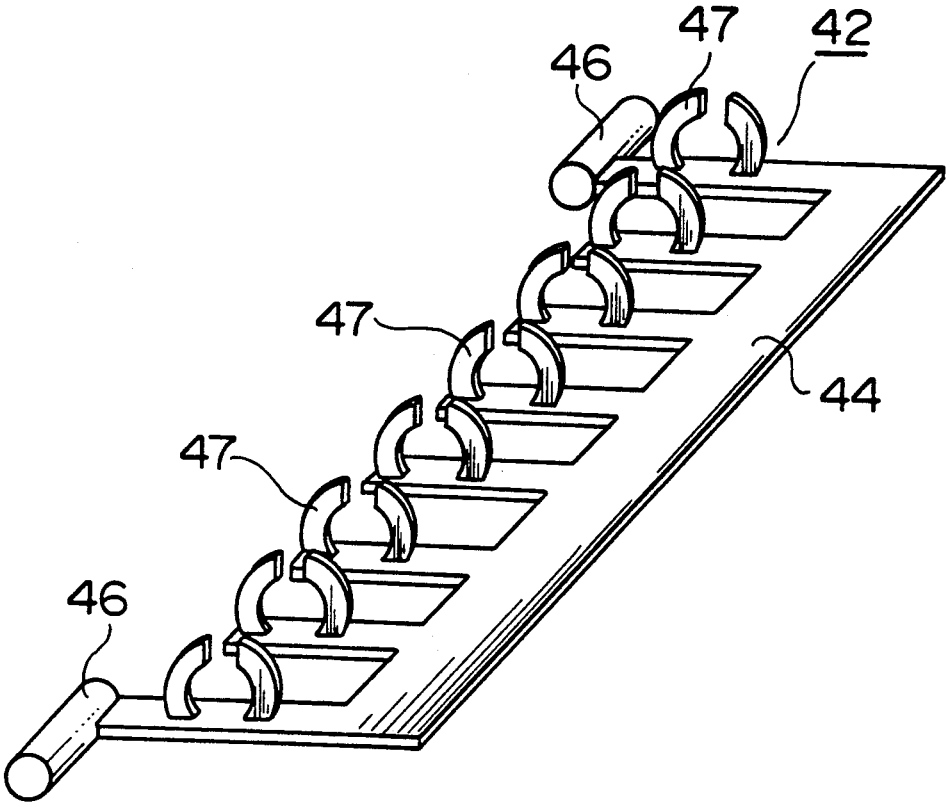
FIG. 9 is a perspective view showing a further example of the keep plate.

FIGS. 7 through 9 show other embodiments of the keeper plate 42, respectively.

The keeper plate 42 shown in FIGS. 7 and 8 is provided on the top surface thereof with engageable portions 47 for engaging the keeper plate 42 with the roller shaft 38 of the pressure roller 37 in a manner not to disturb the rotation of the roller shaft 38, and these engageable portions 47 are engaged with the roller shaft 38 to support the keeper plate 42 on the roller shaft 38.

Furthermore, the keeper plate 42 shown in FIG. 9 has enagageable shafts 46 in addition to the engageable portions 47.

The driving roller 32 is rotated by the rotation transmitted from the ratchet driving portion 5 through the rotation transmitting portion 34.

The rotation transmitting portion 34 is constituted by a gear wheel 51 fixed to the ratchet 20 of the ratchet driving portion 5 and rotatable integrally with the ratchet 20, a gear wheel 52 fixed to the roller shaft 33 of the driving roller 32 and intermediate gear wheels 53, 54 provided between the gear wheels 51 and 52, for transmitting the rotation of the gear wheel 51 to the gear wheel 52. The rotation of the ratchet 20 makes the driving roller 32 rotate through the gear wheels 51, 53, 54 and 52. Tooth members of the gear wheels 51, 53, 54 and 52 are set in such a manner that ratchet 20 rotated by one opening of the lid member 3 can transmit a rotation to the driving roller 32 such that the paper 6 delivered from the driving roller 32 and the pressure roller 37 by the rotation of the driving roller 32 will be delivered in a predetermined length, i.e. the length covering the closet seat 4.

Figure 10:
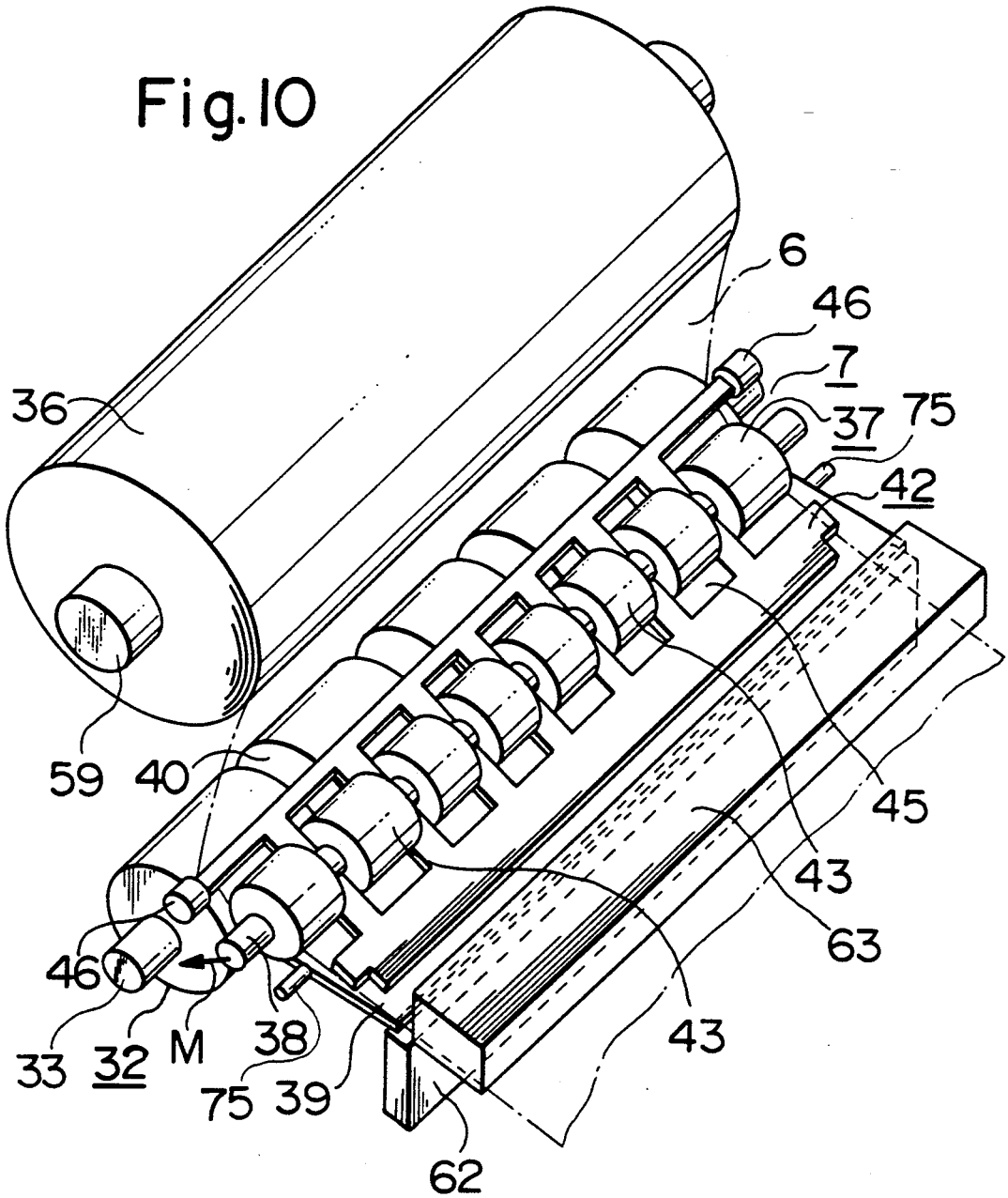
FIG. 10 is a perspective view showing the paper delivery roller portion.

FIG. 10 shows the positional relationship between the driving roller 32 and the pressure roller 37 and the positional relationship between the keeper plate 42 and the introducing plate 39 with respect to the pair of rollers 32 and 37.

The pressure roller 37 is mounted at a position of about 45 degrees around the driving roller 32 and is constantly urged by a biasing means such as a spring (not shown) in a direction indicated by an arrow M to pressure-contact the driving roller 32.

The keeper plate 42 is supported by support member 55, 56, supporting the driving roller 32 and the pressure roller 37.

Figure 11:
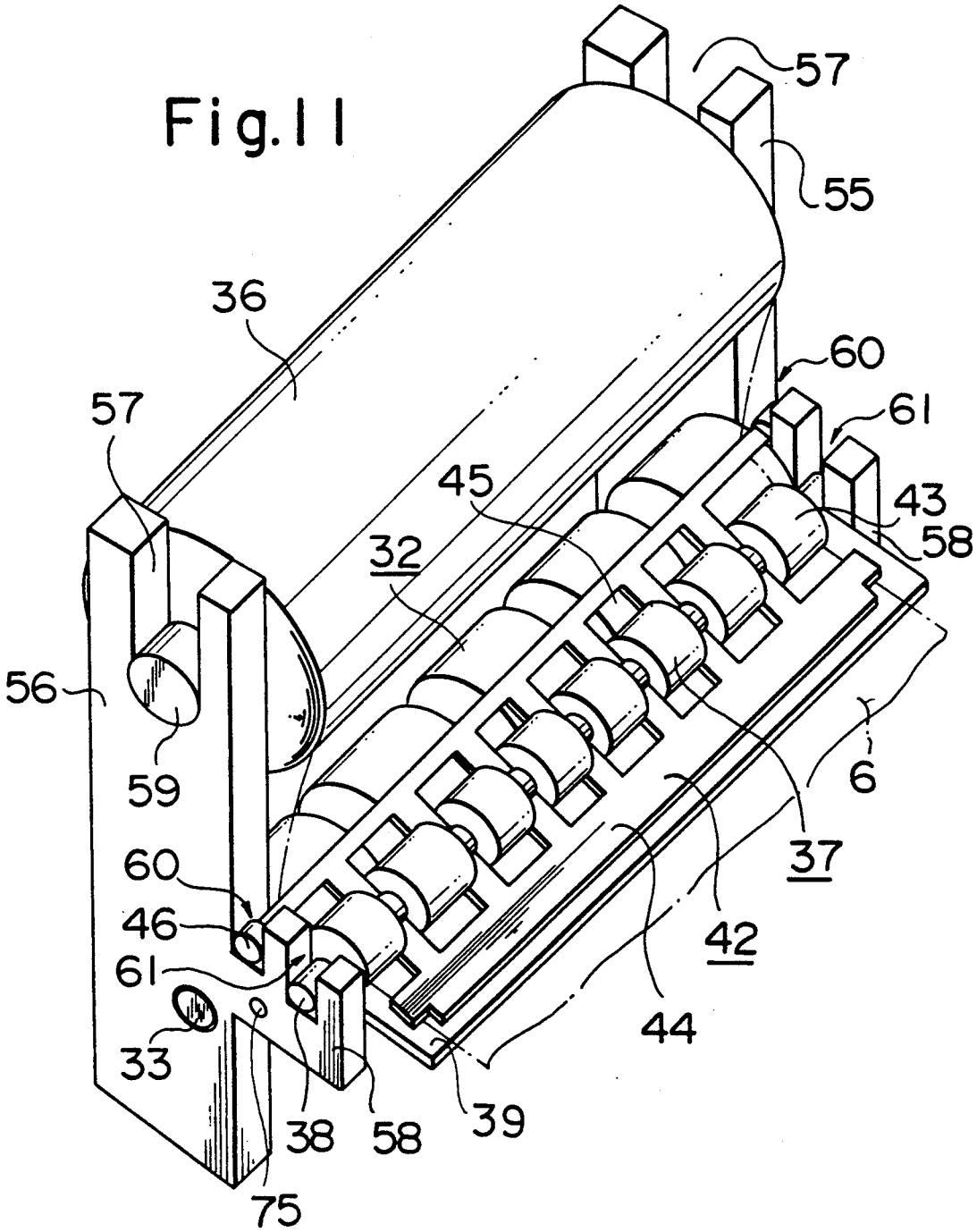
FIG. 11 is a perspective view showing a state where the paper delivery roller portion is supported by support members.

FIG. 11 shows an embodiment in which the driving roller 32 and the pressure roller 37 are supported by the support members 55, 56.

Designated at 57 are U-shaped grooves formed at the top portions of the support members 55, 56, and designates arms thereon. A shaft 59 of the roll 36 of the paper 6 is rotatably positioned in the U-shaped grooves 57. The roll 36 is stabilized by gravity because the U-shaped grooves 57 are formed in the upwardly open direction.

Furthermore, denoted at 60, 61 are upwardly opened coupling grooves in the arms 58, and there is a difference in stage between the coupling grooves 60 and 61. Engaged in the coupling grooves 60 are the engageable shafts 46 provided at the opposite ends of the top side of the plate member 44 forming the keeper plate 42. Furthermore, rotatably coupled into the other coupling grooves 61 is the roller shaft 38 of the pressure roller 37. When the roller shaft 38 is coupled into the coupling grooves 61, the pressure roller 37 pressure-contacts the driving roller 32.

Figure 12:
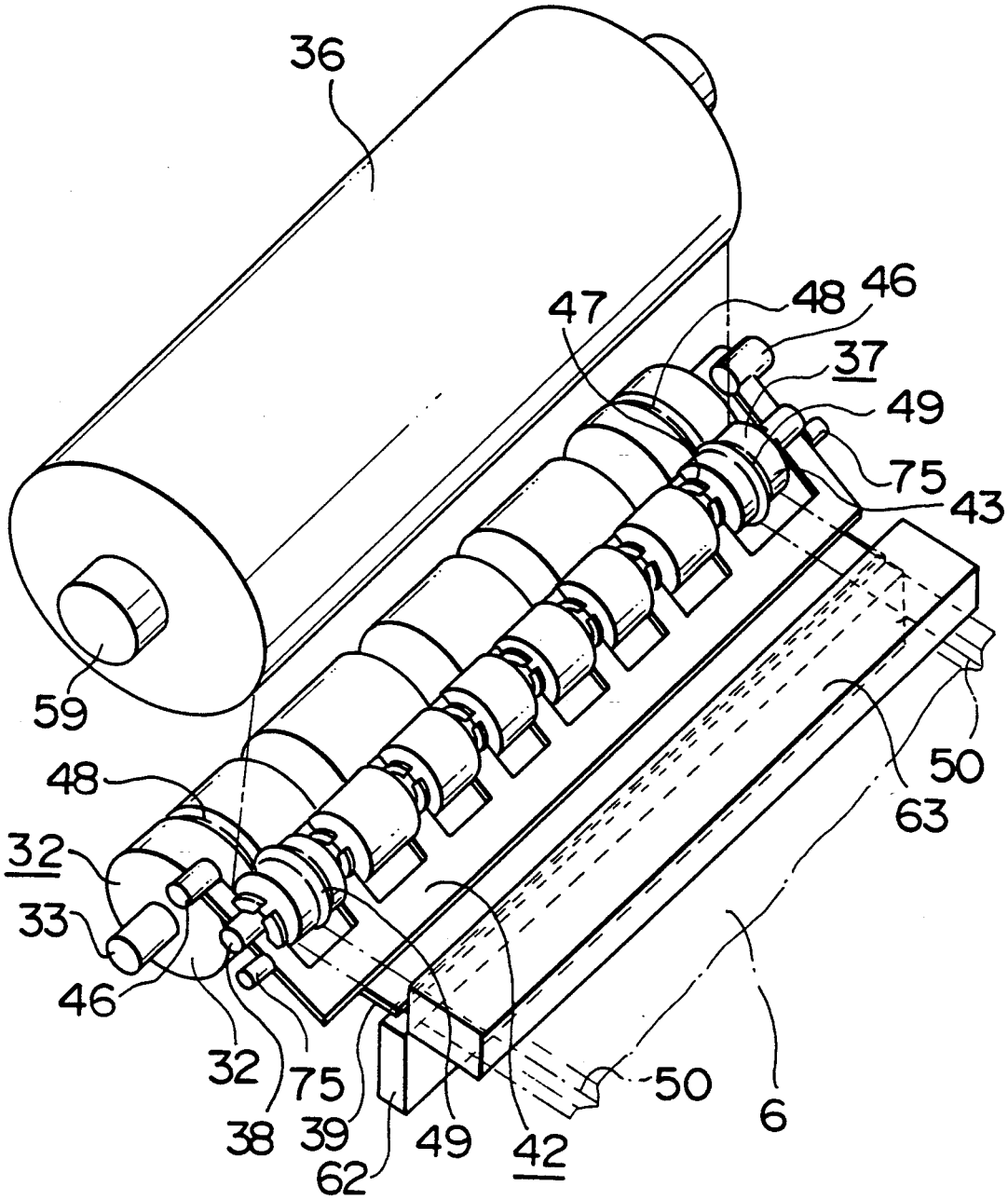
FIG. 12 is a perspective view showing another embodiment of the driving roller and the pressure roller, which constitute the paper delivery roller portion.
Figure 13:
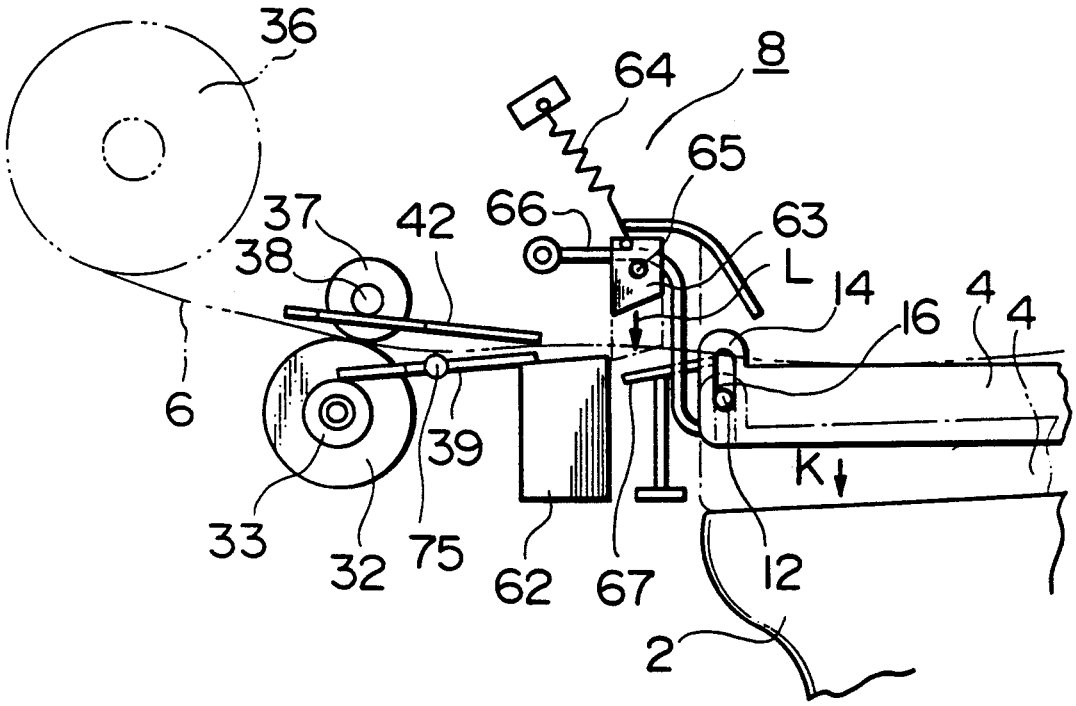
FIG. 13 is an explanatory view showing the cutter portion therearound.
Figures 14, 15:
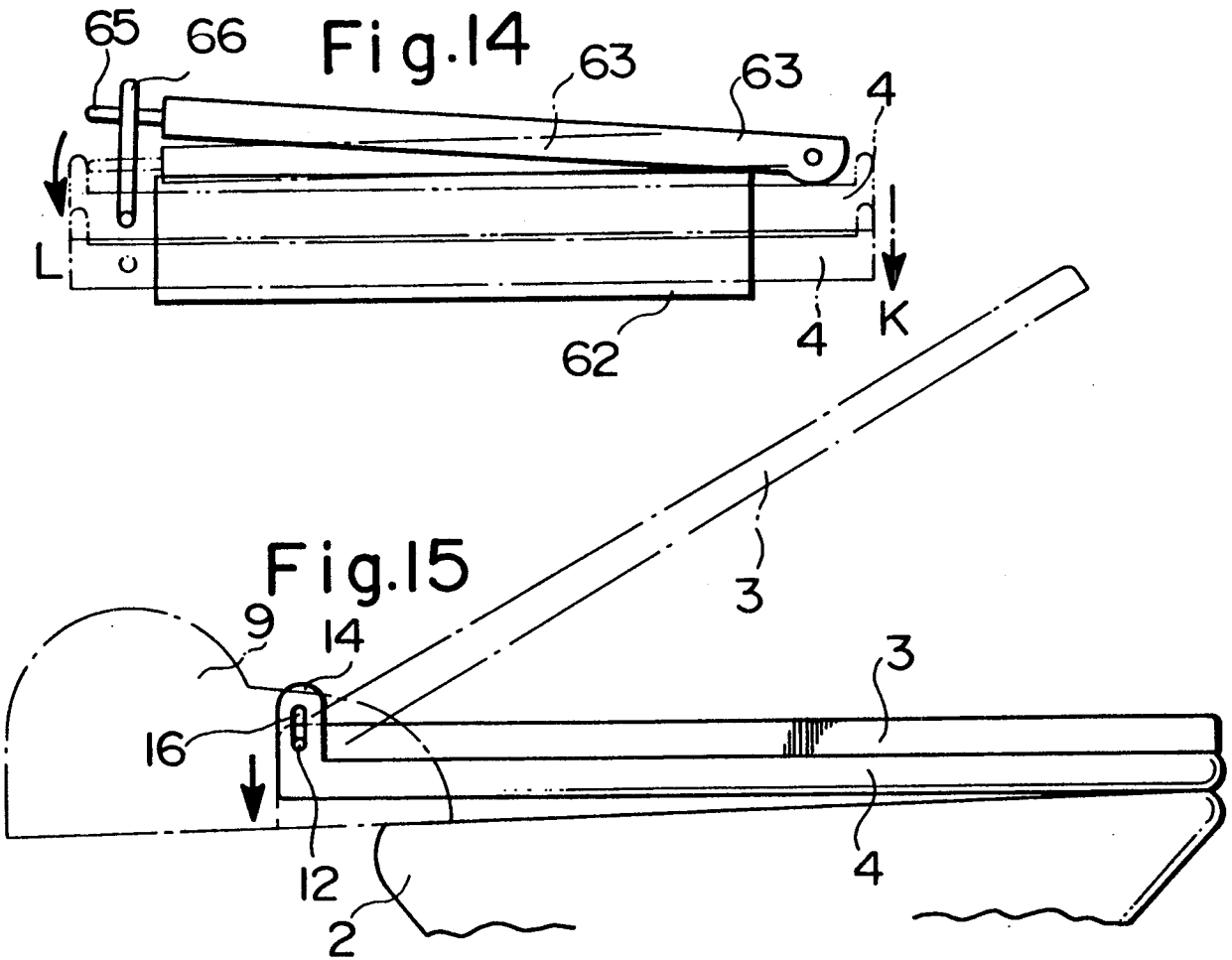
FIG. 14 is an explanatory view showing the movement of the blade in the cutter portion.
FIG. 15 is an explanatory view showing the movement of the closet seat for operating the cutter portion.
Figure 16:
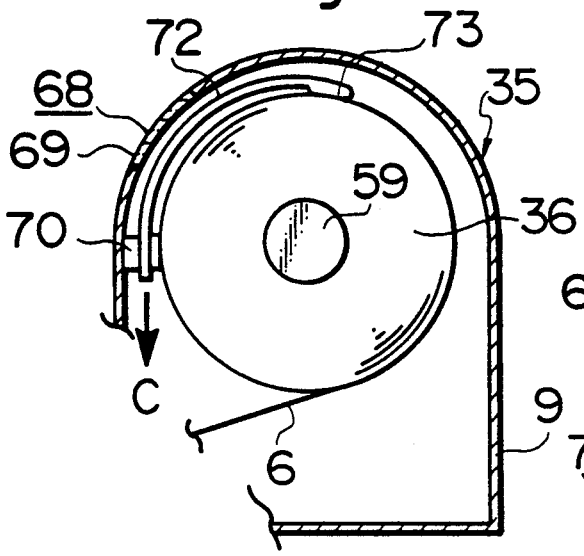
FIG. 16 is a sectional view showing a storage portion for the roll of paper stored in the box member.

FIG. 12 shows another embodiment illustrating the driving roller 32 and the pressure roller 37, which constitute the paper delivery roller portion 7.

Annular concave portions 48, 48 each having a small width are circularly formed at opposite end portions of the driving roller 32. These two annular concave portions 48, 48 are positioned at the inner sides within the width of the paper 6 delivered from the roll 36.

Furthermore, annular concave portions 49, 49 are circularly formed on the rollers 43 of the pressure roller 37 at portions corresponding to the annular concave portions 48, 48 formed on the driving roller 37.

Thus, the paper 6 is clamped between the driving roller 32 and the pressure roller 37 at the opposite end portions thereof by the annular concave portions 48, 48 and the annular convex portions 49, 49 to be folded, whereby rectilinear folded portions 50, 50 are formed at opposite end portions of the paper 6 as it is delivered in the forwarding direction. These folded portions 50, 50 prevent the paper 6 delivered from the roll 36 from warping vertically, thus improving the direct advance of the paper.

A description will now be given of the cutter portion 8 for cutting off the paper 6 delivered from the paper delivery roller portion 7.

A stationary lower blade 62 is positioned in parallel to the paper delivery roller portion 7 and below the paper 6 delivered on the delivery side of the paper delivery roller portion 7. On the other hand, a movable upper blade 63 is positioned over the paper 6 delivered and vertically rotatably supported at one end thereof by one end of the stationary lower blade 62. The movable upper blade 63 is constantly pulled up by a spring 64, and the stationary lower blade 62 and the movable upper blade 63 are in an opened state, whereby the paper 6 is delivered from the paper delivery roller portion 7 and is guided by the introducing plate 39 and the keeper plate 42 to pass through a space formed between the stationary lower blade 62 and the movable upper blade 63 and supplied onto the closet seat 4. An engageable bar 65 is provided at one end portion of the movable upper blade 63. Furthermore, a hook-shaped working bar 66 for engaging the engageable bar 65 is provided at the rear end of the closet seat 4, whereby, when the rear end portion of the closet seat 4 is lowered (in a direction indicated by an arrow K in the drawing), the working bar 66 pulls the engageable bar 65 downwardly to push down the movable upper blade 63, so that the paper 6 can be cut off.

Designated at 67 is a guide plate for guiding the paper 6 delivered onto the closet seat 4.

Figure 17:
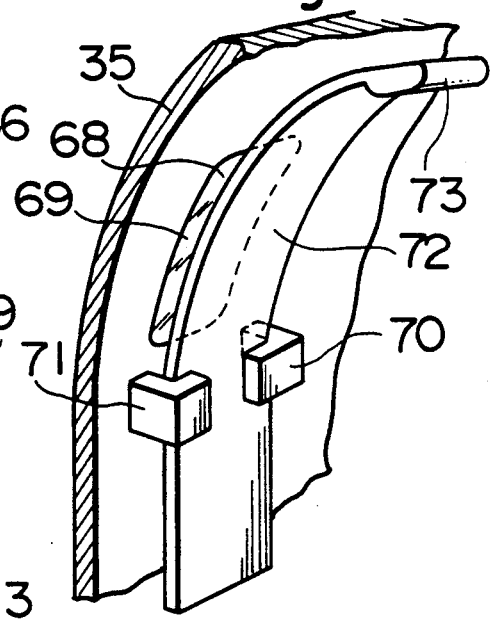
FIG. 17 is a perspective view showing a remaining paper display device for the roll of paper, which is provided on the box member.
Figure 18:
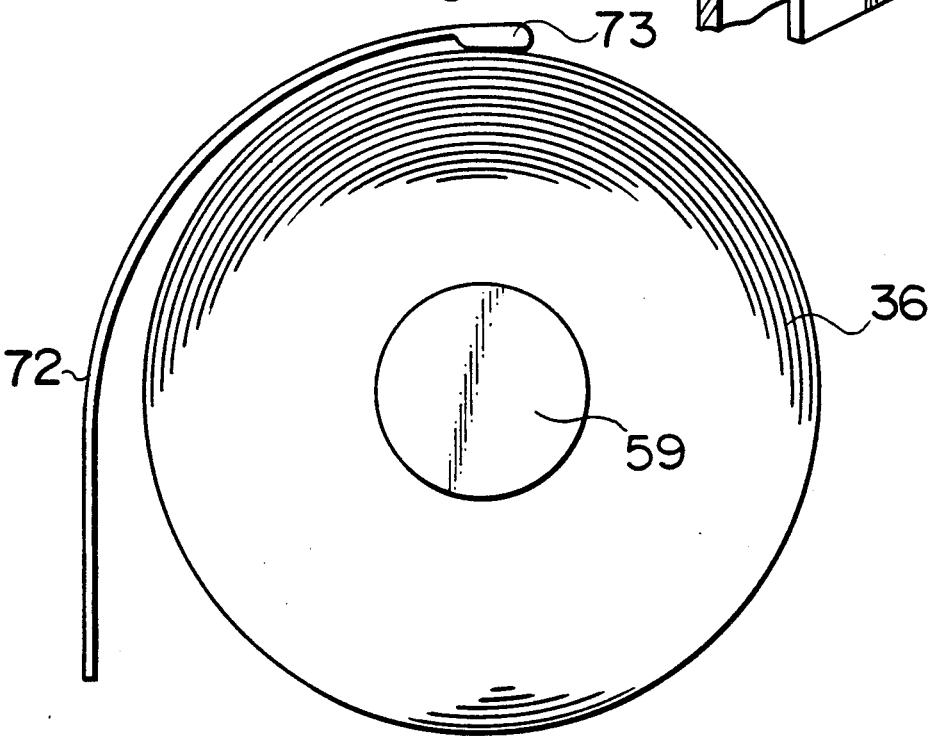
FIG. 18 is a side view showing a scale display plate and the roll of paper.
Figure 19:
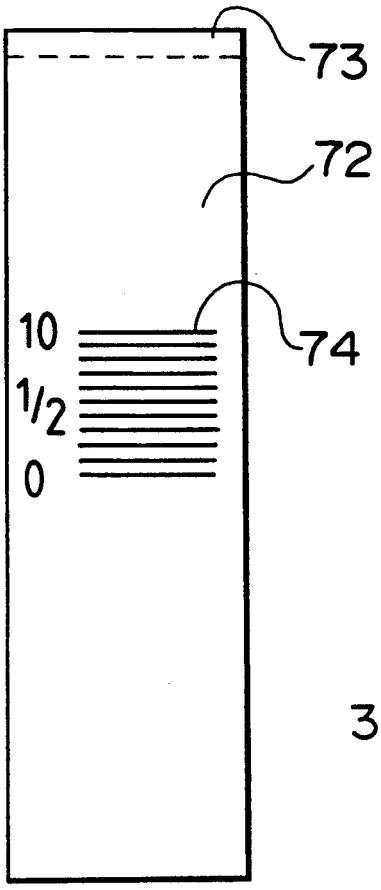
FIG. 19 is a front view showing the scale display plate.
Figure 20:
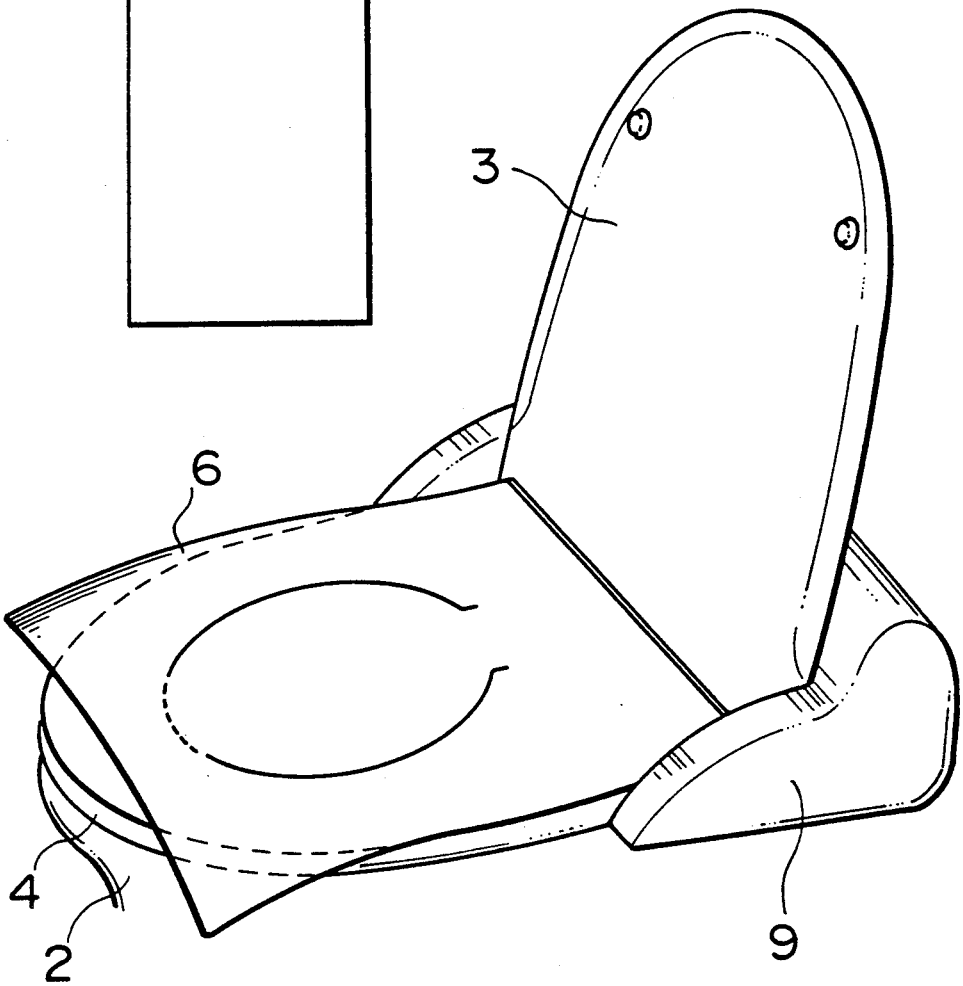
FIG. 20 is an explanatory view showing a state where the box member is opened and the paper is delivered onto the closet seat.

The box member 9 is provided in the upper portion thereof with a storage portion 35 for storing the roll 36 of the paper 6, and a remaining amount display device 68 for the paper 6 is provided in the wall of the storage portion 35. The display device 68 has the following arrangement. A transparent glass piece is embedded in the wall of the storage portion 35 to form a see-through window 69. L-shaped guide pieces 70, 71 are opposed to each other on the rear surface of the storage portion 35 as shown in FIG. 17. A scale display plate 72 is vertically slidably inserted into a space formed between the guide pieces 70, 71 and the wall surface. This scale display plate 72 is curved at the upper portion thereof and formed at the forward end thereof with an engaging projection 73 which is engaged with the top portion of the roll 36 stored in the storage portion 35. Furthermore, a graduation scale 74 which can be seen through the see-through window 69, for displaying the remaining amount of the roll 36 is displayed on the front surface of the scale display plate 72. As the paper 6 is pulled out to reduce the diameter of roll 36, the scale display plate 72 slides downwardly, so that the graduation scale 74 of the scale display plate 72 can be read from the see-through window 69 to learn the remaining amount of paper on the roll 36.

As has been described above, the apparatus for delivering the paper for the closet seat according to the present invention can offer such advantages that, by opening the lid member, the paper stored as a roll in the box member can be pulled out in the predetermined length to be laid on the closet seat and, by sitting on the closet seat having the paper therein, the paper can be cut off, so that the operation of laying the paper can be performed easily, shifting of the paper and falling off when sitting down is avoided, the closet seat can easily be used without paying any special attention, the arrangement of the apparatus is simplified, and the apparatus can be secured to the conventional closet bowl, thus making installation inexpensive.

What is claimed is:

1. An apparatus for delivering paper for a water closet seat, comprising:

a lid member having a rear end portion;

a box member adapted to be secured to an upper rear side of a closet bowl and means for rotatably supporting said rear end portion in said box member;

a closet seat for the closet bowl, said closet seat being engaged with an under side of said lid member and having a rear end portion means for rotatably and vertically movably supporting the rear end portion of said closet seat in said box member, and spring means urging said closet seat toward said lid member;

a ratchet driving portion including a ratchet and means rotatably supporting said ratchet on said box member and a pawl provided on said lid member and engagable with said ratchet upon raising of said lid member from the closet bowl for rotating said ratchet through a predetermined angle;

a paper delivery roller portion positioned within said box member including means connecting a driving roller to said ratchet whereby said driving roller is rotatable by the rotation of said ratchet, and a pressure roller disposed in parallel with said driving roller and rotatable by the rotation of said driving roller for gripping paper stored in said box member between said driving roller and said pressure roller and pulling the paper out of said box member upon rotation of said driving roller and pressure roller and delivering a predetermined length of paper along a paper path to between said lid member and said closet seat; means for rotatably supporting said rollers in the box member and a cutter portion disposed proximate a delivery side of said paper delivery roller portion and having a stationary lower blade disposed below the paper path and a movable upper blade vertically movably disposed above the paper path, said movable upper blade being operatively associated with the rear end portion of said closet seat for being pushed downwardly by the downward movement of said closet seat to thereby cut off the paper between the movable upper blade and the stationary lower blade.

* * * * *